US010850170B1

(12) United States Patent
Cornelius et al.

(10) Patent No.: US 10,850,170 B1
(45) Date of Patent: Dec. 1, 2020

(54) GOLF CLUB HEAD

(71) Applicant: Acushnet Company, Fairhaven, MA (US)

(72) Inventors: David S. Cornelius, San Marcos, CA (US); Grant M. Martens, San Diego, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 16/427,611

(22) Filed: May 31, 2019

(51) Int. Cl.
*A63B 53/04* (2015.01)
*A63B 60/00* (2015.01)

(52) U.S. Cl.
CPC ..... *A63B 53/0466* (2013.01); *A63B 53/047* (2013.01); *A63B 60/00* (2015.10); *A63B 53/0408* (2020.08); *A63B 53/0416* (2020.08); *A63B 53/0437* (2020.08); *A63B 2053/0491* (2013.01)

(58) Field of Classification Search
CPC ... A63B 53/0466; A63B 60/00; A63B 53/047; A63B 2053/0437; A63B 2053/0408; A63B 2053/0416; A63B 2053/0491
See application file for complete search history.

(56) References Cited

U.S. PATENT DOCUMENTS 5,221,086 A * 6/1993 Antonious ..... A63B 53/04 473/327
5,511,786 A * 4/1996 Antonious ..... A63B 53/04 473/327
5,706,566 A * 1/1998 Igarashi ..... A63B 53/04 29/527.5
6,168,537 B1 * 1/2001 Ezawa ..... A63B 53/04 473/327
D484,937 S * 1/2004 Madore ..... D21/742
7,959,523 B2 * 6/2011 Rae ..... A63B 53/0466 473/345
8,317,636 B2 * 11/2012 Evans ..... A63B 53/0466 473/345
8,516,675 B2 * 8/2013 Evans ..... A63B 53/0466 29/407.05
8,696,489 B2 * 4/2014 Gibbs ..... A63B 53/0466 473/329
8,858,359 B2 * 10/2014 Willett ..... A63B 60/00 473/327
9,421,433 B2 8/2016 Martens et al.
9,526,956 B2 12/2016 Murphy et al.
9,707,456 B2 7/2017 Sanchez et al.
9,707,457 B2 * 7/2017 Mata ..... A63B 53/06
9,802,089 B2 * 10/2017 Honea ..... A63B 53/047
9,839,820 B2 12/2017 Bennett et al.
(Continued)

*Primary Examiner* — Stephen L Blau

(57) ABSTRACT

A metalwood golf club head, including a striking face, wherein the striking face comprises a geometric face center, a posterior body portion comprising a crown and a sole, wherein the crown is connected to an upper portion of the striking face and the sole is connected to a lower portion of the striking face, a vertical plane passing through the geometric face center, a neutral axis extending through the geometric face center, the neutral axis perpendicular to an outer surface of the striking face at the geometric face center, wherein a vertical plane through said geometric face center intersects a first crown peak at a distance at least 30 mm from said geometric face center along the z-direction.

15 Claims, 5 Drawing Sheets

(56) References Cited

U.S. PATENT DOCUMENTS

| | | | | |
|---|---|---|---|---|
| 9,901,791 | B2 * | 2/2018 | Mizutani | A63B 53/0466 |
| 9,975,012 | B2 | 5/2018 | Sanchez et al. | |
| 10,099,092 | B2 | 10/2018 | Morin et al. | |
| 10,363,463 | B2 * | 7/2019 | Willett | A63B 60/00 |
| 2003/0220154 | A1 * | 11/2003 | Anelli | A63B 53/0466<br>473/327 |
| 2018/0178092 | A1 * | 6/2018 | Johnson | A63B 53/08 |
| 2019/0247724 | A1 * | 8/2019 | Shimahara | A63B 53/04 |
| 2020/0114223 | A1 * | 4/2020 | Burnett | A63B 53/0466 |

* cited by examiner

GOLF CLUB HEAD

TECHNICAL FIELD

This present technology generally relates to systems, devices, and methods related to golf clubs, and more specifically to metal wood golf clubs.

DESCRIPTION OF THE RELATED TECHNOLOGY

In the competitive industry of golf club design, distance and accuracy are two of the most important performance factors that help define the desirability of a metal wood type golf club. Although some may argue that the look, feel, and sound of a golf club may influence their opinion of a golf club; there is no arguing that the performance factors play a major role in determining the desirability of a golf club. The performance factors of maximizing distance while maintaining accuracy becomes even more prevalent in a metal wood type golf club head. Unlike iron type golf club heads where accuracy of a golf shot clearly trumps the distance benefits gained by any individual golf club, metal wood type golf club heads are designed to allow a golfer to hit the golf ball as far as possible and as straight as possible.

In order to maximize distance while maintaining accuracy of a metal wood type golf club head, metal wood type golf clubs have been designed with the objective of maximizing the distance of a golf ball struck by a golf club head close to the geometric center of the golf club head. This geometric center of the golf club head, due to the inherent laws of physics, may generally produce a golf shot that maximizes the distance by reducing the energy loss during impact between the golf ball and the golf club head. In order to quantify this value, the United States Golf Association (USGA), in conjunction with the golfing industry, have come up with various methods such as the calculation the Coefficient of Restitution (COR) or the calculation of the Characteristic Time (CT) as ways to quantify the rebounding characteristic of a golf ball after it impacts a golf club head.

Developments in maximizing distance while maintaining accuracy of a metal wood type golf club head are generally premised upon the golfer be capable of generating the maximum club head speed when hitting the golf ball and being able to square the club head at impact. Longer shafts, lighter heads and different head shapes can lead to increased club head speed at impact. However, some factors can also lead to a decrease in the accuracy of impacts leading to inaccurate shots, or more dispersion. Thus, the need to optimize metal wood constructions remains.

SUMMARY

The systems, methods, and devices described herein have innovative aspects, no single one of which is indispensable or solely responsible for their desirable attributes. Without limiting the scope of the claims, some of the advantageous features will now be summarized.

One aspect of the present technology is the realization that conventional golf clubs do not provide maximum club head speed at impact. Thus, there exists a need for an improved golf club head construction. The present technology is directed to metal wood golf clubs. The present invention provides improved golf club head constructions. As a result, a golfer can strike the golf ball with the geometric center of the striking face and obtain increased distance.

One non-limiting embodiment of the present technology includes a metal wood golf club head, including a striking face; wherein the striking face comprises a geometric face center; a posterior body portion including a crown and a sole, wherein the crown is connected to an upper portion of the striking face and the sole is connected to a lower portion of the striking face; a hosel located on a heel side of the golf club head; a toe side located opposite the heel side; a coordinate system including: an x-direction parallel to a ground plane when the golf club head is grounded upon the ground plane according to the prescribed lie and loft of the golf club head, the x-direction substantially parallel to the striking face, the x-direction extending in a positive direction towards the heel of the golf club head; a y-direction perpendicular to the x-direction, the y-direction perpendicular to the ground plane, the y-direction extending in a positive direction upwards toward the crown; a z-direction perpendicular to the x-direction and y-direction, the z-direction parallel to the ground plane, the z-direction extending in a positive direction forwards towards the striking face; wherein the golf club head comprises a golf club head interior, wherein the golf club head comprises an outer surface, the outer surface opposite the golf club head interior; a vertical plane passing through the geometric face center; a neutral axis extending through the geometric face center, the neutral axis perpendicular to an outer surface of the striking face at the geometric face center; a crown return extending back from an upper face limit of the striking face towards the posterior portion; a sole return extending back from a lower face limit of the striking face towards the posterior portion; and a vertical plane through the geometric face center intersects a first crown peak CP1 at a distance Z1 that is at least 30 mm from the geometric face center along the z-direction.

In an additional non-limiting embodiment of the present technology the golf club head includes a second vertical plane located 15 mm toeward along the x-direction from the geometric face center that intersects a second crown peak CP2 at a distance Z2 at least 30 mm from the geometric face center along the z-direction.

In an additional non-limiting embodiment of the present technology the golf club head includes a maximum crown peak CPM depth that is located between the first crown peak CP1 and second crown peak CP2 in the x-direction.

In an additional non-limiting embodiment of the present technology the golf club head includes a third vertical plane located 30 mm toeward along the x-direction from the geometric face center that intersects a third crown peak CP3 at a distance Z3 less than 27 mm from the geometric face center along the z-direction.

In an additional non-limiting embodiment of the present technology the golf club head includes a fourth vertical plane located 15 mm heelward along the x-direction from the geometric face center that intersects a fourth crown peak CP4 at a distance Z4 less than 27 mm from the geometric face center along the z-direction.

In an additional non-limiting embodiment of the present technology the golf club head includes a fifth vertical plane located 30 mm heelward along the x-direction from the geometric face center that intersects a fifth crown peak CP5 at a distance Z5 less than 24 mm from the geometric face center along the z-direction.

In another non-limiting embodiment of the present technology the golf club head includes (1) first vertical plane through the geometric face center that intersects a first crown peak CP1 at a distance Z1 at least 30 mm from the geometric face center along the z-direction; (2) a second vertical plane located 15 mm toeward along the x-direction from the geometric face center that intersects a second crown peak CP2 at a distance Z2 at least 30 mm from the geometric face center along the z-direction; (3) a third vertical plane located 30 mm toeward along the x-direction from the geometric face center that intersects a third crown peak CP3 at a distance Z3 less than 27 mm from the geometric face center along the z-direction; and (4) a fourth vertical plane located 15 mm heelward along the x-direction from the geometric face center that intersects a fourth crown peak CP4 at a distance Z4 less than 27 mm from the geometric face center along the z-direction; and wherein the distance Z1 and distance Z2 are at least 10 percent greater than the distance Z3 and distance Z4.

In another non-limiting embodiment of the present technology the golf club head includes: (1) first vertical plane through the geometric face center that intersects a first crown peak CP1 at a distance Z1 at least 30 mm from the geometric face center along the z-direction; (2) a second vertical plane located 15 mm toeward along the x-direction from the geometric face center that intersects a second crown peak CP2 at a distance Z2 at least 30 mm from the geometric face center along the z-direction; and (3) a fifth vertical plane located 30 mm heelward along the x-direction from the geometric face center that intersects a fifth crown peak CP5 at a distance Z5 less than 24 mm from the geometric face center along the z-direction; and wherein the distance Z1 and distance Z2 are at least 20 percent greater than the distance Z5.

One non-limiting embodiment of the present technology includes a metal wood golf club head, including a striking face; wherein the striking face comprises a geometric face center; a posterior body portion including a crown and a sole, wherein the crown is connected to an upper portion of the striking face and the sole is connected to a lower portion of the striking face; a hosel located on a heel side of the golf club head; a toe side located opposite the heel side; a coordinate system including: an x-direction parallel to a ground plane when the golf club head is grounded upon the ground plane according to the prescribed lie and loft of the golf club head, the x-direction substantially parallel to the striking face, the x-direction extending in a positive direction towards the heel of the golf club head; a y-direction perpendicular to the x-direction, the y-direction perpendicular to the ground plane, the y-direction extending in a positive direction upwards toward the crown; a z-direction perpendicular to the x-direction and y-direction, the z-direction parallel to the ground plane, the z-direction extending in a positive direction forwards towards the striking face; wherein the golf club head comprises a golf club head interior, wherein the golf club head comprises an outer surface, the outer surface opposite the golf club head interior; a vertical plane passing through the geometric face center; a neutral axis extending through the geometric face center, the neutral axis perpendicular to an outer surface of the striking face at the geometric face center; a crown return extending back from an upper face limit of the striking face towards the posterior portion; a sole return extending back from a lower face limit of the striking face towards the posterior portion; and wherein a vertical plane through the geometric face center intersects a first crown peak CP1 at a distance Z1 at least 30 mm from the geometric face center along the z-direction; wherein the crown has a first forward convex arc AF1 in the vertical plane through the geometric face center that extends forward 10 mm from the first crown peak CP1 and a first aft convex arc AA1 in the vertical plane through the geometric face center that extends back 10 mm from the first crown peak CP1; wherein the first forward convex arc AF1 has a forward radius RF1 and the first aft convex arc AA1 has an aft radius RA1 that is less that the forward radius RF1. In a preferred embodiment, the forward radius RF1 is at least 25% larger than the aft radius RA1, and more preferably, at least 40% larger.

In an additional non-limiting embodiment of the present technology the golf club head includes a crown that has a second forward convex arc AF2 in a second vertical plane located 15 mm in the toeward direction from the face center in the x-direction. The second forward convex arc extends forward 10 mm from the second crown peak CP2. A second aft convex arc AA2 in the second vertical plane extends back 10 mm from the second crown peak CP2. The second forward convex arc AF2 has a forward radius RF2 and the second aft convex arc AA2 has an aft radius RA2 that is less that the forward radius RF2.

In an additional non-limiting embodiment of the present technology the golf club head includes a second vertical plane located 15 mm in the x-direction from the face center that intersects a second crown peak CP2. The crown has a second forward convex arc AF2 in the second vertical plane that extends forward 10 mm from the second crown peak CP2 and a second aft convex arc AA2 in the second vertical plane that extends back 10 mm from the second crown peak CP2. The second forward convex arc AF2 has a forward radius RF2 and the second aft convex arc AA2 has an aft radius RA2 that is less that the forward radius RF2, and preferably by at least 25 percent.

In an additional non-limiting embodiment of the present technology the golf club head includes a fourth vertical plane located 15 mm heelward from the face center in the x-direction that intersects a fourth crown peak CP4. The crown has a fourth forward convex arc AF4 extending forward 10 mm from the fourth crown peak CP4 in the fourth vertical plane and a fourth aft convex arc AA4 in the fourth vertical plane extending 10 mm back from the fourth crown peak CP4. The fourth forward convex arc AF4 has a forward radius RF4 and the fourth aft convex arc AA4 has a fourth aft radius RA4 that is greater that the forward radius RF4.

In an additional non-limiting embodiment of the present technology the golf club head includes the fourth vertical plane that extends through the fourth crown peak CP4, wherein the crown has a fourth forward convex arc AF4 extending forward 10 mm from the fourth crown peak CP4 and a fourth aft convex arc AA4 in the fourth vertical plane extending 10 mm back from the fourth crown peak CP4. The fourth forward convex arc AF4 has a forward radius RF4 and the fourth aft convex arc AA4 has a fourth aft radius RA4 that is equal to or greater than the forward radius RF4. Preferably, the fourth aft radius RA4 is less than 10 percent greater than the forward radius RF4.

In an additional non-limiting embodiment of the present technology the golf club head includes a fifth vertical plane located 30 mm from the face center in the x-direction that extends through the fifth crown peak CP5. The crown has a fifth forward convex arc AF5 extending forward 10 mm from the fifth crown peak CP5 and a fifth aft convex arc AA5 in the fifth vertical plane extending 10 mm back from the fifth crown peak CP5. The fifth forward convex arc AF5 has a forward radius RF5 and the fifth aft convex arc AA5 has an aft radius RA5 that is greater that the forward radius RF5.

In an additional non-limiting embodiment of the present technology the fifth vertical plane that extends through the fifth crown peak CP5 has a fifth forward convex arc AF5 extending forward 10 mm from the fifth crown peak CP5 and a fifth aft convex arc AA5 in the fifth vertical plane extending 10 mm back from the fifth crown peak CP5. The fifth forward convex arc AF5 has a forward radius RF5 and the fifth aft convex arc AA5 has an aft radius RA5 that is at least 100 percent greater than the forward radius RF5.

Another non-limiting embodiment of the present invention is a metal wood golf club head, comprising: a striking face with a geometric face center, a posterior body portion comprising a crown and a sole, wherein the crown is connected to the upper portion of the striking face and the sole is connected to the lower portion of the striking face, a hosel located on a heel side of the club head, and a toe side located opposite the heel side. The club head has a coordinate system comprising: an x-direction parallel to a ground plane when the golf club head is grounded upon the ground plane according to the prescribed lie and loft of the golf club head, and extends in a positive direction towards the heel of the golf club head; a y-direction perpendicular to the x-direction, extending in a positive direction upwards toward the crown; and a z-direction perpendicular to the x-direction and y-direction, the z-direction extending in a positive direction forwards towards the striking face. The club head is further defined by a crown return extending back from an upper face limit of the striking face towards the posterior portion. The crown return comprises a forward crown portion adjacent the striking face and a rear crown portion further from the striking face, where the forward crown portion is separated from the rear crown portion by a crown peak ridge. The crown peak ridge is defined as apex of the crown in the y-direction for all vertical planes in the z-direction from the hosel to the toe side of the club head. In other words, the crown peak ridge is the line of the highest points in the y-direction of the crown when going from the face to the back of the club head. In the present invention, the crown peak ridge is preferably concave relative to the striking face at a first vertical plane in the z-direction that extends through the face center and is convex relative to the striking face at a heel portion and at a toe portion.

In a preferred embodiment, the golf club head has a crown peak ridge with a first concave radius of curvature at the face center, a second convex radius of curvature at the toe portion and a third convex radius of curvature at the heel portion, where the first radius of curvature is greater than the second radius of curvature and less than the third radius of curvature. More preferably, the first radius of curvature is between 25 mm and 50 mm, the second radius of curvature is less than 25 mm, and the third radius of curvature is greater than 50 mm. In another preferred embodiment of the present invention, the sum of the first radius of curvature, the second radius of curvature and the third radius of curvature is less than 200 mm. Preferably, the transition of the crown peak ridge from concave relative to the striking face to convex relative to the striking face at the heel portion is between 10 mm and 30 mm from the face center in the x-direction and the transition of the crown peak ridge from concave relative to the striking face to convex relative to the striking face at the toe portion is between 15 mm and 50 mm from the face center in the negative x-direction.

BRIEF DESCRIPTION OF THE DRAWINGS

The accompanying drawings form a part of the specification and are to be read in conjunction therewith. The illustrated embodiments, however, are merely examples and are not intended to be limiting. Like reference numbers and designations in the various drawings indicate like elements.

DETAILED DESCRIPTION

Figure 1:
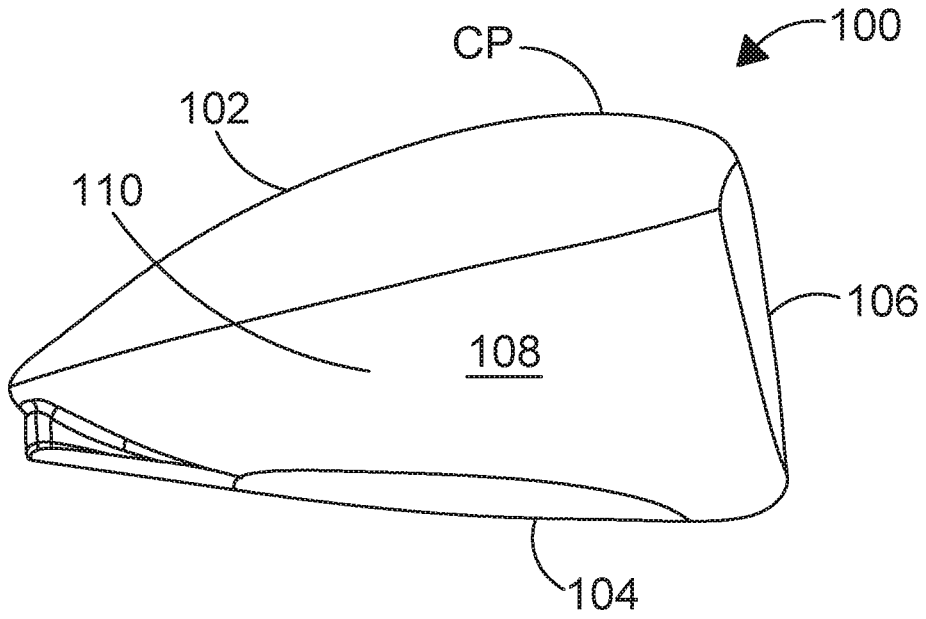
FIG. 1 illustrates a side view of a prior art golf club head.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further modifications of inventive features illustrated herein, and additional applications of the principles of the inventions as illustrated herein, which would occur to one skilled in the relevant art and having possession of this disclosure, are to be considered within the scope of the invention.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

In describing the present technology, the following terminology may have been used: The singular forms "a," "an," and "the" include plural referents unless the context clearly dictates otherwise. Thus, for example, reference to an item includes reference to one or more items. The term "plurality" refers to two or more of an item. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. A plurality of items may be presented in a common list for convenience. However, these lists should be construed as though each member of the list is individually identified as a separate and unique member. Thus, no individual member of such list should be construed as a de facto equivalent of any other member of the same lists solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to a selection of one of two or more alternatives, and is not intended to limit the selection of only those listed alternative or to only one of the listed alternatives at a time, unless the context clearly indicated otherwise.

Features of the present disclosure will become more fully apparent from the following description and appended claims, taken in conjunction with the accompanying drawings. After considering this discussion, and particularly after reading the section entitled "Detailed Description" one will understand how the illustrated features serve to explain certain principles of the present disclosure.

FIG. 1 illustrates a toe view of a prior art golf club head 100. The club head 100 includes a crown 102, a sole 104 and a striking face 106. The striking face 106 is located at the front of the golf club head 100 and is configured to impact a golf ball when the golf club is swung. A hosel (not shown) can include a shaft bore configured to receive a portion of the shaft, and more particularly, is preferably an interchangeable shaft mechanism such as those depicted in U.S. Pat. No. 10,188,913, which is incorporated by reference herein in its entirety. The hosel is generally located on the heel side of the golf club head, which is opposite the toe side 108. The crown 102 portion may generally be connected to an upper portion of the striking face 106 while the sole 104 may generally be connected to a bottom portion of the striking face 106. The skirt 110 can be juxtaposed between the crown 102 and the sole 104 to complete the posterior body portion of the club head. When the golf club head 100 is in the standard address position, the highest point on the crown is the crown peak CP.

Figure 2:
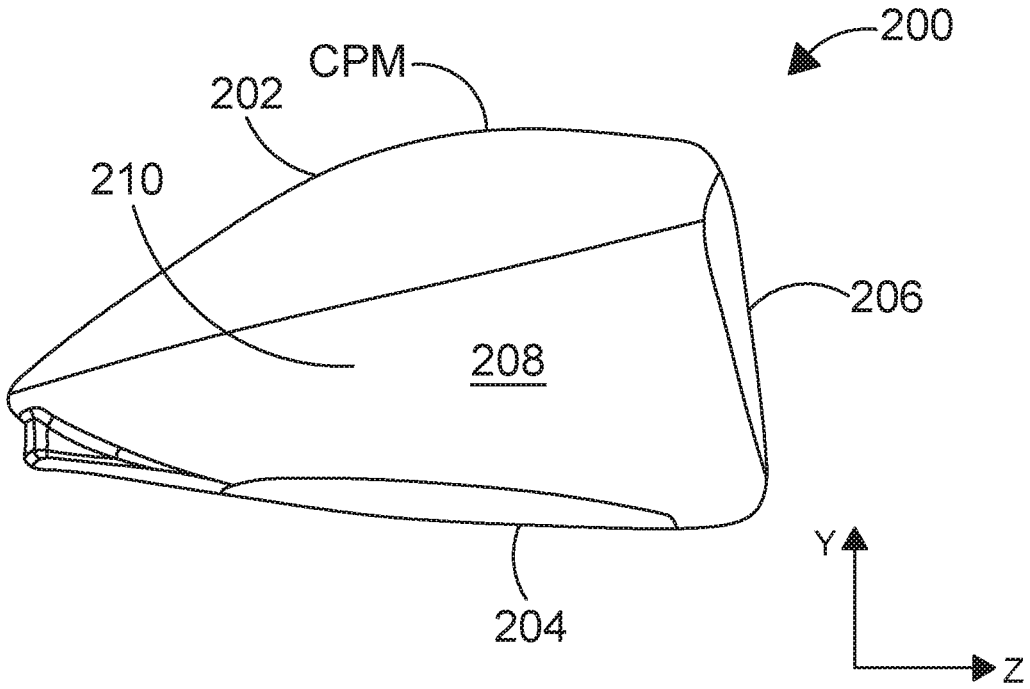
FIG. 2 illustrates a side view of a golf club head according to the present invention.
Figure 3:
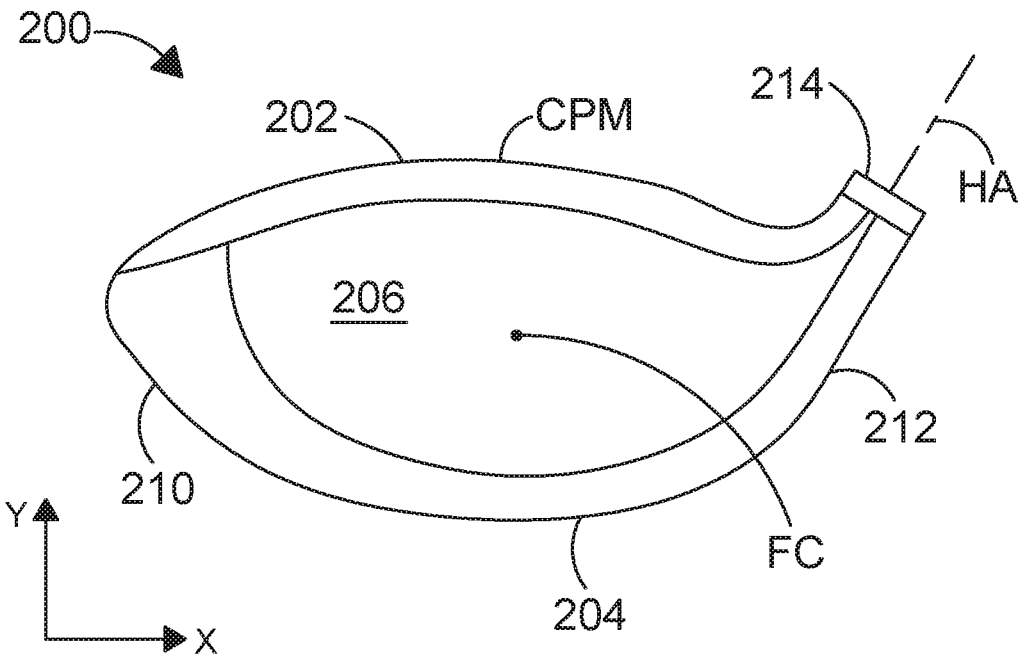
FIG. 3 illustrates a front view of the golf club head of FIG. 2.
Figure 4:
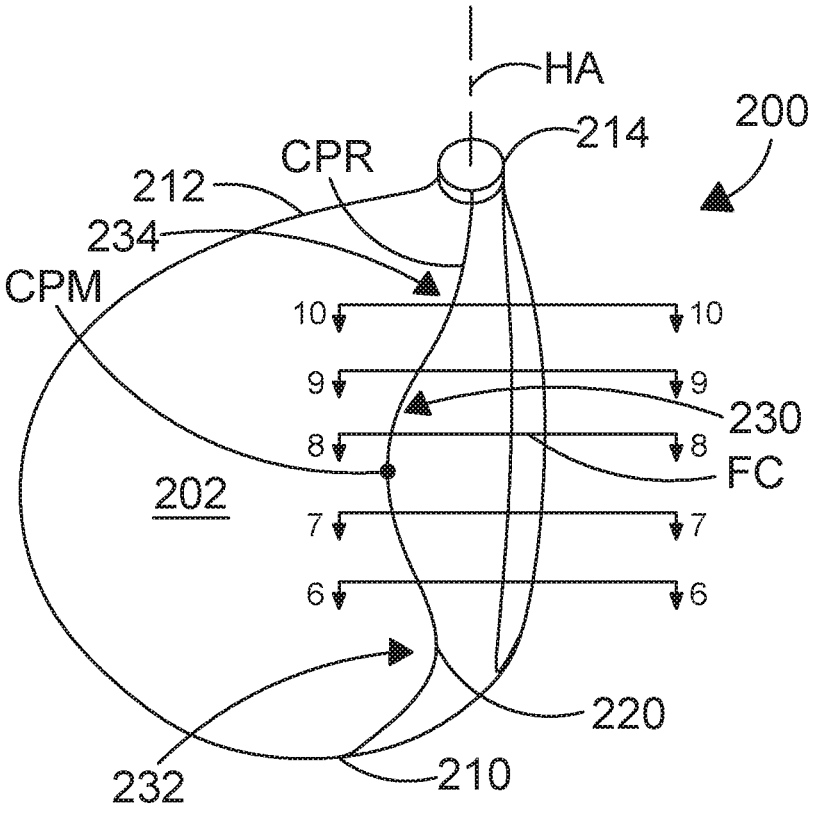
FIG. 4 illustrates a top view of the golf club head of FIG. 2.

FIGS. 2-4 illustrate a golf club head 200, which is an example of golf club heads according to the present invention. The club head 200 includes a crown 202, a sole 204 and a striking face 206. The club head 200 is preferably made from titanium alloys, steel alloys, composites, or a combination thereof. In a preferred embodiment, the club head 200 is formed from a titanium alloy with a face 206 formed from a second titanium alloy. In another embodiment, the club head 200 is formed from a titanium alloy with a face 206 formed from a second titanium alloy and at least a portion of a crown 202 formed from a non-metallic material such as a composite.

The striking face 206 is located at the front of the golf club head 200 and is configured to impact a golf ball when the golf club is swung. A hosel 214 can include a shaft bore along the hosel axis HA configured to receive a tip portion of the shaft. The hosel 214 is generally located on the heel side 212 of the golf club head, which is opposite the toe side 210. The crown 202 portion is connected to an upper portion of the striking face 206 and extends back to the back end. The sole 204 may generally be connected to a bottom portion of the striking face 206. When the golf club head 200 is in the standard address position, the highest point on the crown is the crown peak CP.

Figure 5:
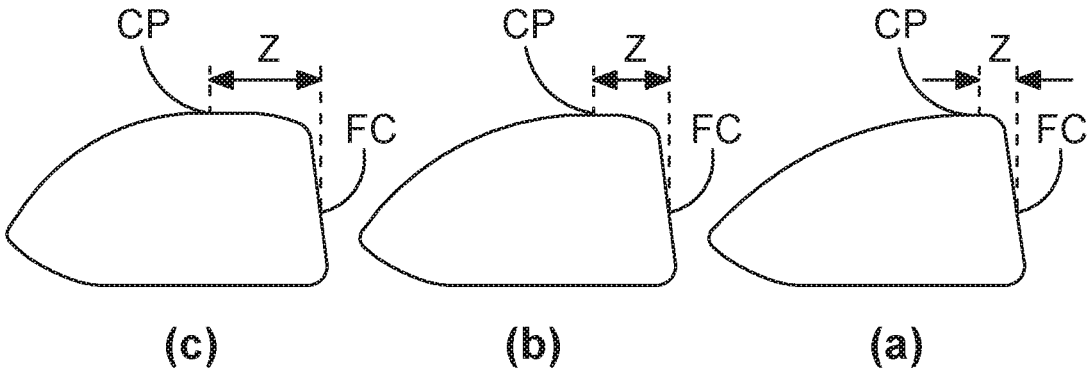
FIG. 5 illustrates comparative examples of golf club heads cut vertically through the geometric face center of the golf club head.

FIG. 5 illustrates a toe view of three linearly extruded club head sections having identical width, face height, crown peak height and frontal projections. However, the profiles have different crown peak depths in order to illustrate how the change in crown peak depth affects drag. In the first club head section (a) the crown peak CP is at a crown peak depth Z of only 14 mm from the face center FC. In the second club head section (b) the crown peak depth Z is 26.5 mm from the face center FC. In the third club head section (c), the crown peak depth Z is 39 mm from the face center FC. The coefficient of drag of the second club head section is only 4% less than the first club section. However, the coefficient of drag for the third club head section is 34% less than the first club head section. Thus, there is a significant reduction in the coefficient of drag associate with moving the crown peak further back in the z-direction by more than 30 mm, but not less than 30 mm.

Figure 8:
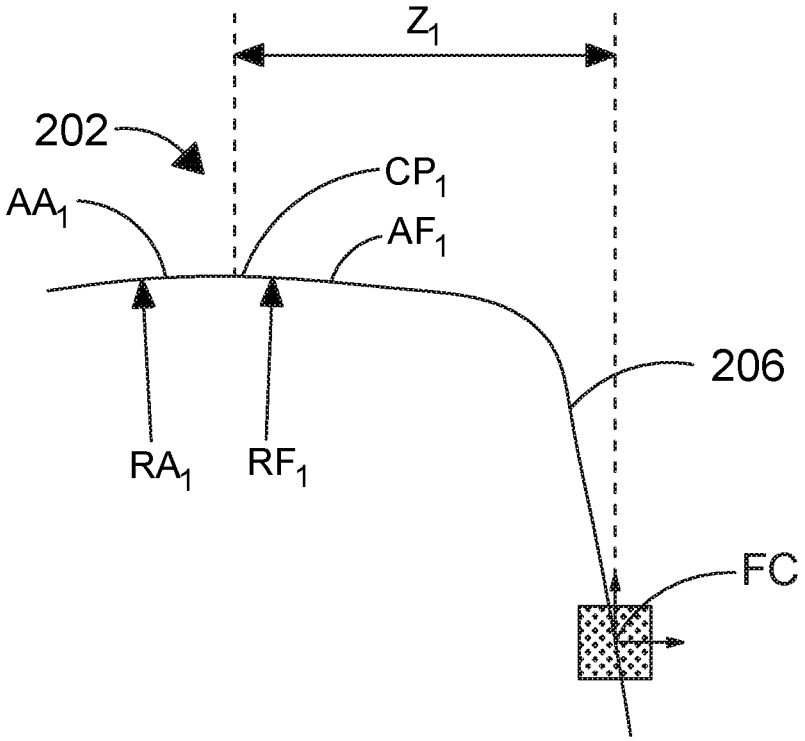
FIG. 8 illustrates the outer surface of the front portion of the cross-section 8-8 of the golf club head of FIG. 4.
Figure 9:
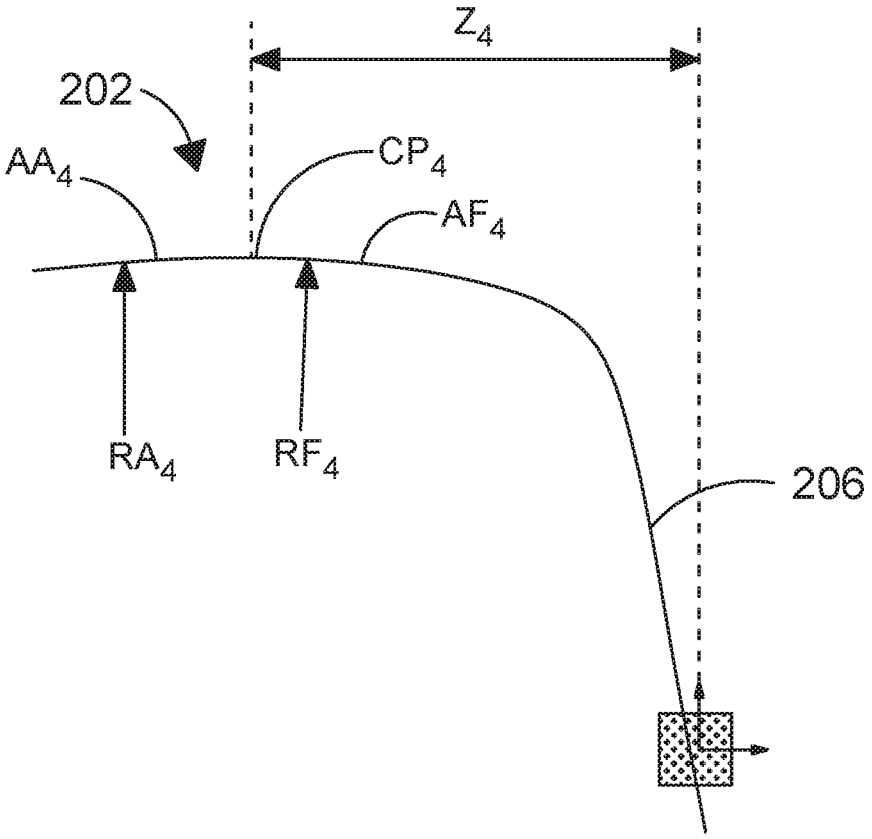
FIG. 9 illustrates the outer surface of the front portion of the cross-section 9-9 of the golf club head of FIG. 4.
Figure 10:
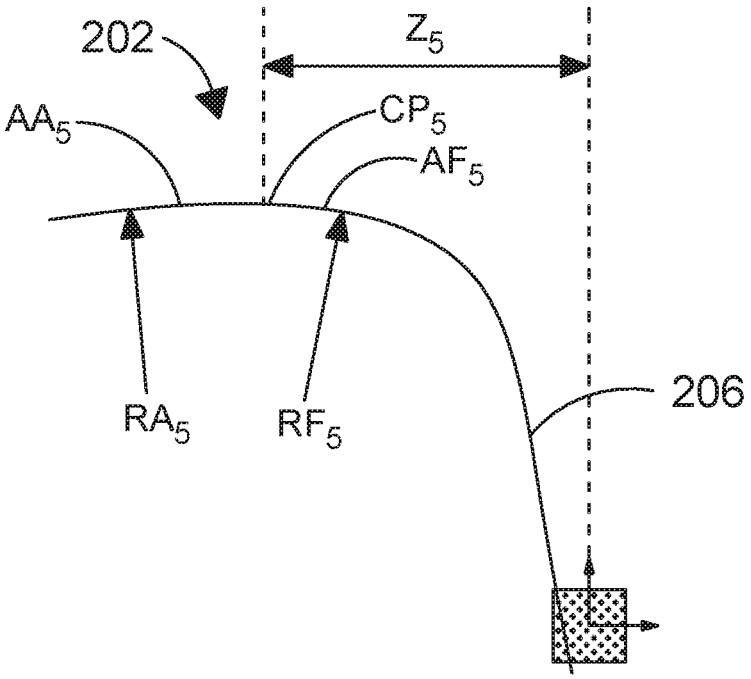
FIG. 10 illustrates the outer surface of the front portion of the cross-section 10-10 of the golf club head of FIG. 4.

FIG. 8 illustrates a cross-sectional view of the top portion of the golf club head 200 of FIG. 4. The metal wood golf club head 200 includes the striking face 206 with a geometric face center FC. The golf club head 200 comprises a crown outer surface 202 that is illustrated in a vertical plane passing through the geometric face center in the Z direction. The surface 202 includes a crown return extending back from an upper face limit of the striking face 206 towards the posterior portion. As shown, the vertical plane through the geometric face center FC intersects a first crown peak CP1 at a distance Z1 at least 30 mm from the geometric face center FC along the z-direction. Preferably, the first crown peak CP1 is located at a distance Z1 of about 30 mm to 35 mm from the face center FC in the z-direction and has a vertical height from the ground surface, y-g, of about 59.5 mm to 63.5 mm. The crown surface 202 has a first forward convex arc AF1 in the vertical plane through the geometric face center extending forward 10 mm from the first crown peak CP1 and a first aft convex arc AA1 in the vertical plane through the geometric face center extending back 10 mm from the first crown peak CP1. The first forward convex arc AF1 has a forward radius RF1 and the first aft convex arc AA1 has an aft radius RA1 that is less that the forward radius RF1. In a preferred embodiment, the forward radius RF1 is between about 115 mm and 155 mm and is at least 25% larger than the aft radius RA1, which is between about 70 mm and 110 mm. More preferably, the forward radius RF1 is about 40% larger than the aft radius RA1.

Figure 7:
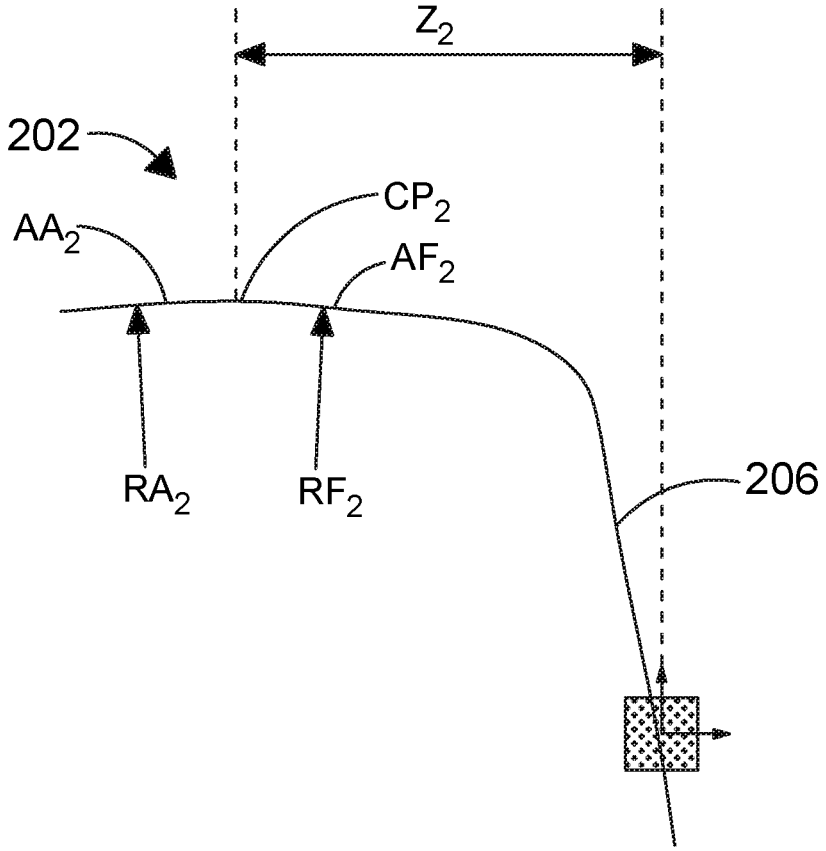
FIG. 7 illustrates the outer surface of the front portion of the cross-section 7-7 of the golf club head of FIG. 4.

FIG. 7 illustrates a cross-sectional view of the top portion of the golf club head 200 of FIG. 4. The metal wood golf club head 200 includes the striking face 206 with a geometric face center FC. The golf club head 200 comprises an outer surface 202 that is illustrated in a vertical plane passing in the Z direction through a point 15 mm toeward from the geometric face center FC. The surface 202 includes a crown return extending back from an upper face limit of the striking face 206 towards the posterior portion. As shown, the second vertical plane located 15 mm toeward along the x-direction from the geometric face center FC intersects a second crown peak CP2 at a distance Z2 that is at least 28 mm, and more preferably at least 30 mm, from the geometric face center along the z-direction. Most preferably, the second crown peak CP2 is located a distance Z2 that is between about 28 mm and 33 mm from the face center FC in the z-direction and has a vertical height from the ground surface, y-g, of about 60 mm to 64 mm. The height, y-g, of CP@ is preferably greater than the height of CP1.

The crown surface 202 also has a second forward convex arc AF2 in the second vertical plane that extends forward 10 mm from the second crown peak CP2 and a second aft convex arc AA2 in the second vertical plane that extends back 10 mm from the second crown peak CP2. The second forward convex arc AF2 has a forward radius RF2 and the second aft convex arc AA2 has an aft radius RA2 that is less that the forward radius RF2. Preferably, the second forward radius RF2 is between about 115 mm and 155 mm and the aft radius RA2 is between about 80 mm and 120 mm.

Furthermore, as shown in FIGS. 2, 3 and 4, the preferred golf club head 200 includes a maximum crown peak CPM that is the largest height from the ground surface, y-g, on the crown surface 202. The maximum crown peak CPM has a depth a distance Zm from the face center in the z-direction that is greater than Z1 and Z2. Preferably, the maximum crown peak CPM has a depth a distance Zm from the face center in the z-direction that is between about 30 mm and 37 mm. The maximum crown peak CPM is preferably located between the first crown peak CP1 and second crown peak CP2 in the x-direction and more preferably, between about −5 mm and −10 mm in the x-direction from the face center FC. The maximum crown peak CPM has a vertical height from the ground surface, y-g, that is less than 65 mm, and more preferably less than 64 mm, and most preferably less than 63 mm. Preferably, the maximum crown peak has a height from the ground surface, y-g, of about 60 mm to 64 mm.

Figure 6:
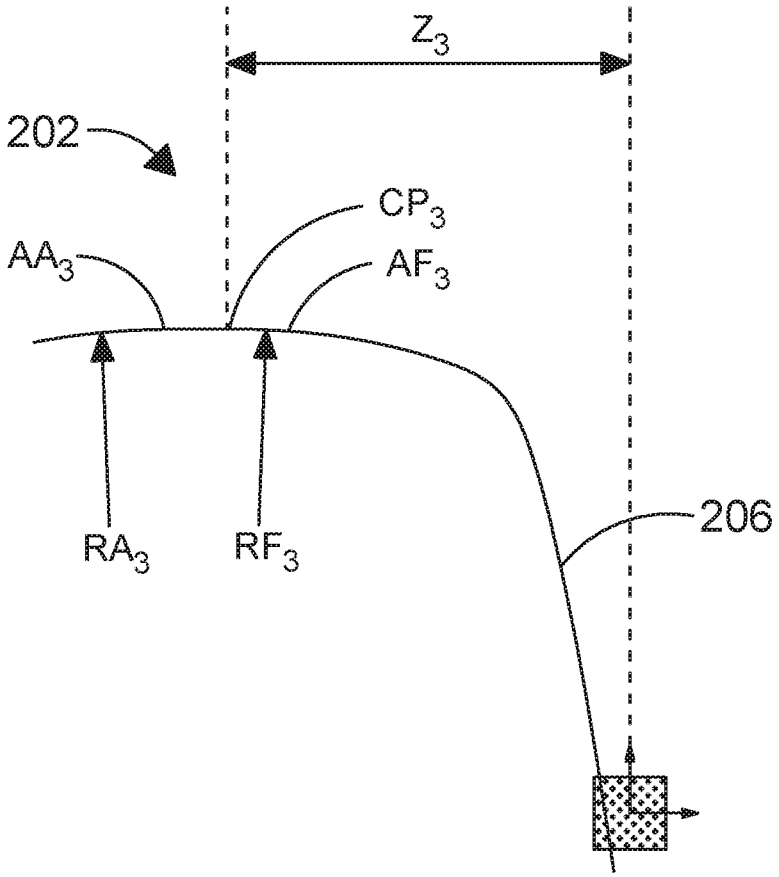
FIG. 6 illustrates the outer surface of the front portion of the cross-section 6-6 of the golf club head of FIG. 4.

Additionally, as shown in FIG. 6, the golf club head 200 preferably includes a third vertical plane in the z-direction and located 30 mm toeward along the x-direction from the geometric face center FC that intersects a third crown peak CP3 at a distance Z3 that is less than 27 mm from the geometric face center FC along the z-direction. Preferably, the third crown peak CP3 is located at a depth Z3 that is between about 22 mm and 28 mm from the geometric face center FC along the z-direction and has a vertical height from the ground surface, y-g, of about 58 mm to 62 mm. The crown surface 202 in the third vertical plane has a third forward convex arc AF3 extending forward 10 mm from the third crown peak CP3 and a third aft convex arc AA3 extending 10 mm back from the third crown peak CP3. Preferably, the third forward convex arc AF3 has a forward radius RF3 and the third aft convex arc AA3 has an aft radius RA3 that is greater that the forward radius RF3. More preferably, the aft radius RA3 is at least about 25% greater than the forward radius RF3, and most preferably, at least about 50% greater. Preferably, the third forward radius RF3 is between about 50 mm and 90 mm and the third aft radius RA3 is between about 115 mm and 155 mm. Thus, preferably, the forward and aft radii in the toe region as defined by the third plane has the opposite relationship as in the center region as defined by the first and second planes. In other words, the forward radius is substantially larger than the aft radius in the center region and the aft radius is substantially larger than the forward radius in the toe region.

Still further, the golf club head 200 preferably includes a fourth vertical plane in the z-direction and located 15 mm heelward along the x-direction from the geometric face center FC. The fourth vertical plane intersects a fourth crown peak CP4 at a distance Z4 that is less than 27 mm from the geometric face center FC along the z-direction. Preferably, the fourth crown peak CP4 is a distance Z4 that is between about 25 mm to 30 mm from the geometric face center FC in the z-direction and has a vertical height from the ground surface, y-g, of about 58 mm to 62 mm. The crown surface 202 in the fourth vertical plane has a fourth forward convex arc AF4 extending forward 10 mm from the fourth crown peak CP4 and a fourth aft convex arc AA4 extending 10 mm back from the fourth crown peak CP4. Preferably, the fourth forward convex arc AF4 has a forward radius RF4 and the fourth aft convex arc AA4 has an aft radius RA4 that is similar to the forward radius RF4, but larger. More preferably, the fourth aft radius RA4 is less than about 10% greater than the fourth forward radius RF4. Preferably, the fourth forward radius RF4 is between about 70 mm and 110 mm and the fourth aft radius RA4 is between about 70 mm and 110 mm.

Additionally, the golf club head 200 includes a fifth vertical plane in the z-direction that is located 30 mm heelward along the x-direction from the geometric face FC center. The fifth vertical plane preferably intersects a fifth crown peak CP5 at a distance Z5 that less than 24 mm from the geometric face center FC in the z-direction. More preferably, the fifth crown peak CP5 is a distance Z5 that is between about 17 mm to 21 mm from the geometric face center FC in the z-direction and has a vertical height from the ground surface, y-g, of about 53.5 mm to 57.5 mm.

The crown surface 202 in the fifth vertical plane has a fifth forward convex arc AF5 extending forward 10 mm from the fifth crown peak CP5 and a fifth aft convex arc AA5 extending 10 mm back from the fifth crown peak CP5. Preferably, the fifth forward convex arc AF5 has a fifth forward radius RF5 and the fifth aft convex arc AA5 has a fifth aft radius RA5 that is greater than the forward radius RF5. More preferably, the fifth forward radius RF5 is between about 10 mm and 40 mm and the fifth aft radius RA5 is between about 65 mm and 105 mm and the fifth aft radius RA5 is more than 100% greater than the fifth forward radius RF5.

In another non-limiting embodiment of the present technology the golf club head 200 includes a first vertical plane that extends through the geometric face center FC in the z-direction and intersects a first crown peak CP1 at a distance Z1 at least 30 mm from the geometric face center along the z-direction. The club head 200 has a second vertical plane located 15 mm toeward along the x-direction from the geometric face center FC that intersects a second crown peak CP2 at a distance Z2 at least 28 mm from the geometric face center FC along the z-direction. The club head 200 further includes a third vertical plane located 30 mm toeward along the x-direction from the geometric face center FC that intersects a third crown peak CP3 at a distance Z3 that is less than 27 mm from the geometric face center FC along the z-direction. Further still, the club head 200 has a fourth vertical plane located 15 mm heelward along the x-direction from the geometric face center FC that intersects a fourth crown peak CP4 at a distance Z4 that is less than 27 mm from the geometric face center FC along the z-direction. Preferably, the distance Z1 and distance Z2 are at least 10 percent greater than the distance Z3 and distance Z4. More preferably, the club head 200 includes a fifth vertical plane located 30 mm heelward along the x-direction from the geometric face center FC that intersects a fifth crown peak CP5 at a distance Z5 that is less than 24 mm from the geometric face center FC along the z-direction. Preferably, the distance Z1 and distance Z2 are at least 20 percent greater than the distance Z5.

Another non-limiting embodiment of the present invention is a metal wood golf club head 200 comprising a crown return extending back from an upper face limit of the striking face towards the posterior portion. The crown return comprises a forward crown portion adjacent the striking face and a rear crown portion further from the striking face, where the forward crown portion is separated from the rear crown portion by a crown peak ridge CPR. The crown peak ridge CPR is defined as apex of the crown in the y-direction, largest y-g, for all vertical planes in the z-direction from the hosel to the toe side of the club head. In other words, the crown peak ridge CPR is curve of the highest points in the y-direction, y-g, of the crown when going from the face to the back of the club head. In the present invention, the crown peak ridge CPR is preferably concave relative to the striking face in a first vertical plane in the z-direction that extends through the face center and is convex relative to the striking face at a heel portion and at a toe portion.

In a preferred embodiment of the present invention as shown in FIG. 4, the golf club head 200 has a crown peak ridge CPR with a first concave radius of curvature 230 at the face center, a second convex radius of curvature 232 at the toe portion and a third convex radius of curvature 234 at the heel portion. Preferably, the first radius of curvature 230 is greater than the second radius of curvature 232 and less than the third radius of curvature 234. More preferably, the first radius of curvature 230 is between 25 mm and 50 mm, the second radius of curvature 232 is less than 25 mm, and the third radius of curvature 234 is greater than 50 mm. In another preferred embodiment of the present invention, the sum of the first radius of curvature 230, the second radius of curvature 232 and the third radius of curvature 234 is less than 200 mm. Preferably, the transition of the crown peak ridge CPR from concave relative to the striking face to convex relative to the striking face on the heel side of face center FC along the x-direction is between 10 mm and 30 mm from the face center FC in the x-direction and the transition of the crown peak ridge CPR from concave relative to the striking face to convex relative to the striking face on the toe side of face center FC along the x-direction is between 15 mm and 50 mm from the face center FC in the negative x-direction.

The following tables illustrate the preferred embodiment of the present invention.

TABLE 1

| | Y-g (mm) | Z-FC (mm) | X-FC (mm) |
|---|---|---|---|
| CPM | 60-64 | 30-37 | −5 to −10 |
| CP1 | 59.5-63.5 | 30-35 | O |
| CP2 | 60-64 | 28-33 | −15 |
| CP3 | 58-62 | 22-28 | −30 |
| CP4 | 58-62 | 25-30 | 15 |
| CP5 | 53.5-57.5 | 17-21 | 30 |

TABLE 2

| | (mm) |
|---|---|
| RF1 | 115-155 |
| RA1 | 70-110 |
| RF2 | 115-155 |
| RA2 | 80-120 |
| RF3 | 50-90 |
| RA3 | 115-155 |
| RF4 | 70-110 |
| RA4 | 70-110 |
| RF5 | 10-40 |
| RA5 | 65-105 |

In describing the present technology herein, certain features that are described in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

We claim:

1. A metalwood golf club head, comprising:

a striking face;

wherein said striking face comprises a geometric face center;

a posterior body portion comprising a crown and a sole, wherein said crown is connected to an upper portion of said striking face and said sole is connected to a lower portion of said striking face;

a hosel located on a heel side of said golf club head;

a toe side located opposite said heel side;

a coordinate system comprising:

an x-direction parallel to a ground plane when said golf club head is grounded upon said ground plane according to the prescribed lie and loft of said golf club head, said x-direction substantially parallel to said striking face, said x-direction extending in a positive direction towards said heel of said golf club head;

a y-direction perpendicular to said x-direction, said y-direction perpendicular to said ground plane, said y-direction extending in a positive direction upwards toward said crown;

a z-direction perpendicular to said x-direction, said z-direction perpendicular to said y-direction, said z-direction parallel to said ground plane, said z-direction extending in a positive direction forwards from said striking face;

wherein said golf club head comprises a golf club head interior, wherein said golf club head comprises an outer surface, said outer surface opposite said golf club head interior;

a vertical plane passing through said geometric face center in the z-direction;

a neutral axis extending through said geometric face center, said neutral axis perpendicular to an outer surface of said striking face at said geometric face center;

a crown return extending back from an upper face limit of said striking face towards said posterior body portion;

a sole return extending back from a lower face limit of said striking face towards said posterior body portion; and wherein said vertical plane through said geometric face center intersects a first crown peak CP1 at a distance d1 at least 30 mm from said geometric face center along the z-direction;

wherein a second vertical plane extending in the z-direction and located 15 mm toeward along the x-direction from said geometric face center intersects a second crown peak CP2 at a distance d2 at least 30 mm from said geometric face center along the z-direction;

wherein a third vertical plane located 30 mm toeward along the x-direction from said geometric face center intersects a third crown peak CP3 at a distance d3 less than 27 mm from said geometric face center along the z-direction;

wherein a fourth vertical plane located 15 mm heelward along the x-direction from said geometric face center intersects a fourth crown peak CP4 at a distance d4 less than 27 mm from said geometric face center along the z-direction;

wherein said crown has a first forward convex arc AF1 in said vertical plane through said geometric face center extending forward 10 mm from said first crown peak CP1 and a first aft convex arc AA1 in said vertical plane through said geometric face center extending back 10 mm from said first crown peak CP1, wherein said first forward convex arc AF1 has a first radius RF1 and said first aft convex arc AA1 has a second radius RA1 that is less that said first radius RF1;

wherein said crown has a second forward convex arc AF2 in said second vertical plane extending forward 10 mm from said second crown peak CP2 and a second aft convex arc AA2 in said second vertical plane extending 10 mm back from said second crown peak CP2, wherein said second forward convex arc AF2 has a first radius RF2 and said second aft convex arc AA2 has a second radius RA2 that is less that said first radius RF2;

wherein said crown surface has a third forward convex arc AF3 extending forward 10 mm from the third crown peak CP3 and a third aft convex arc AA3 extending 10 mm back from the third crown peak CP3, wherein the third forward convex arc AF3 has a forward radius RF3 and the third aft convex arc AA3 has an aft radius RA3 that is greater that the forward radius RF3; and wherein said crown has a fourth forward convex arc AF4 in said fourth vertical plane extending forward 10 mm from said fourth crown peak CP4 and a fourth aft convex arc AA4 in said fourth vertical plane extending back 10 mm from said fourth crown peak CP4, wherein said fourth forward convex arc AF4 has a first radius RF4 and said fourth aft convex arc AA4 has a second radius RA4 that is greater that said first radius RF4.

2. The golf club head of claim 1, wherein a fifth vertical plane located 30 mm heelward along the x-direction from said geometric face center intersects a fifth crown peak CP5 at a distance d5 less than 24 mm from said geometric face center along the z-direction.

3. The golf club head of claim 2, wherein said distance d1 and said distance d2 are at least 10 percent greater than said distance d3 and said distance d4.

4. The golf club head of claim 3, wherein said distance d1 and said distance d2 are at least 20 percent greater than said distance d5.

5. The golf club head of claim 1, wherein said first radius RF1 is at least 25 percent larger than said second radius RA1.

6. The golf club head of claim 5, wherein said first radius RF2 is at least 25 percent larger than said second radius RA2.

7. The golf club head of claim 6, wherein said first radius RF4 is less than 10 percent smaller than said second radius RA4.

8. A metalwood golf club head, comprising:

a striking face;

wherein said striking face comprises a geometric face center;

a posterior body portion comprising a crown and a sole, wherein said crown is connected to an upper portion of said striking face and said sole is connected to a lower portion of said striking face;

a hosel located on a heel side of said golf club head;

a toe side located opposite said heel side;

a coordinate system comprising:

an x-direction parallel to a ground plane when said golf club head is grounded upon said ground plane according to the prescribed lie and loft of said golf club head, said x-direction substantially parallel to said striking face, said x-direction extending in a positive direction towards said heel of said golf club head;

a y-direction perpendicular to said x-direction, said y-direction perpendicular to said ground plane, said y-direction extending in a positive direction upwards toward said crown;

a z-direction perpendicular to said x-direction, said z-direction perpendicular to said y-direction, said z-direction parallel to said ground plane, said z-direction extending in a positive direction forwards towards said striking face;

wherein said golf club head comprises a golf club head interior, wherein said golf club head comprises an outer surface, said outer surface opposite said golf club head interior;

a vertical plane passing through said geometric face center in the z-direction;

a neutral axis extending through said geometric face center, said neutral axis perpendicular to an outer surface of said striking face at said geometric face center;

a crown return extending back from an upper face limit of said striking face towards said posterior body portion, said crown return comprising a forward crown return adjacent said striking face and a rear crown return further from said striking face, said forward crown return separated from said rear crown return by a crown peak ridge;

wherein the crown peak ridge is the defined as apex of the crown in the y-direction for all vertical planes in the z-direction from the heel side to the toe side of the club head;

wherein the crown peak ridge is concave relative to the striking face at a first vertical plane in the z-direction through the face center and is convex relative to the striking face at a heel portion and a toe portion;

wherein said vertical plane through said geometric face center intersects a first crown peak CP1 at a distance d1 from said geometric face center along the z-direction;

wherein a second vertical plane extending in the z-direction and located 15 mm toeward along the x-direction from said geometric face center intersects a second crown peak CP2 at a distance d2 from said geometric face center along the z-direction;

wherein a third vertical plane located 30 mm toeward along the x-direction from said geometric face center intersects a third crown peak CP3 at a distance d3 which is less than d1 and d2 from said geometric face center along the z-direction;

wherein a fourth vertical plane located 15 mm heelward along the x-direction from said geometric face center intersects a fourth crown peak CP4 at a distance d4 which is less that d1 and d2 from said geometric face center along the z-direction;

wherein said crown has a first forward convex arc AF1 in said vertical plane through said geometric face center extending forward 10 mm from said first crown peak CP1 and a first aft convex arc AA1 in said vertical plane through said geometric face center extending back 10 mm from said first crown peak CP1, wherein said first forward convex arc AF1 has a first radius RF1 and said first aft convex arc AA1 has a second radius RA1 that is less that said first radius RF1;

wherein said crown has a second forward convex arc AF2 in said second vertical plane extending forward 10 mm from said second crown peak CP2 and a second aft convex arc AA2 in said second vertical plane extending 10 mm back from said second crown peak CP2, wherein said second forward convex arc AF2 has a first radius RF2 and said second aft convex arc AA2 has a second radius RA2 that is less that said first radius RF2;

wherein said crown surface has a third forward convex arc AF3 extending forward 10 mm from the third crown peak CP3 and a third aft convex arc AA3 extending 10 mm back from the third crown peak CP3, wherein the third forward convex arc AF3 has a forward radius RF3 and the third aft convex arc AA3 has an aft radius RA3 that is greater that the forward radius RF3; and wherein said crown has a fourth forward convex arc AF4 in said fourth vertical plane extending forward 10 mm from said fourth crown peak CP4 and a fourth aft convex arc AA4 in said fourth vertical plane extending back 10 mm from said fourth crown peak CP4, wherein said fourth forward convex arc AF4 has a first radius RF4 and said fourth aft convex arc AA4 has a second radius RA4 that is greater that said first radius RF4.

9. The golf club head of claim 8, wherein the crown peak ridge has a first radius of curvature at the face center, a second radius of curvature at the toe portion and a third radius of curvature at the heel portion; and wherein the first radius of curvature is greater than the second radius of curvature and less than the third radius of curvature.

10. The golf club head of claim 9, wherein the first radius of curvature is between 25 mm and 50 mm.

11. The golf club head of claim 10, wherein the second radius of curvature is less than 25 mm.

12. The golf club head of claim 11, wherein the third radius of curvature is greater than 50 mm.

13. The golf club head of claim 9, wherein the sum of the first radius of curvature, the second radius of curvature and the third radius of curvature is less than 200 mm.

14. The golf club head of claim 8, wherein the transition of the crown peak ridge from concave relative to the striking face to convex relative to the striking face at the heel portion is between 10 mm and 30 mm from the face center along the x-direction.

15. The golf club head of claim 8, wherein the transition of the crown peak ridge from concave relative to the striking face to convex relative to the striking face at the toe portion is between 15 mm and 50 mm from the face center along the x-direction.

* * * * *